US011696627B2

(12) United States Patent
Chen

(10) Patent No.: US 11,696,627 B2
(45) Date of Patent: Jul. 11, 2023

(54) WALKING STICK GRIP

(71) Applicant: Nai-Ching Chen, Taichung (TW)

(72) Inventor: Nai-Ching Chen, Taichung (TW)

( * ) Notice: Subject to any disclaimer, the term of this patent is extended or adjusted under 35 U.S.C. 154(b) by 88 days.

(21) Appl. No.: 17/525,974

(22) Filed: Nov. 15, 2021

(65) Prior Publication Data

US 2022/0160086 A1 May 26, 2022

(30) Foreign Application Priority Data

Nov. 24, 2020 (TW) ..... 109141049

(51) Int. Cl.
*A45B 9/02* (2006.01)
*A45B 9/00* (2006.01)

(52) U.S. Cl.
CPC ..... *A45B 9/02* (2013.01); *A45B 2009/002* (2013.01); *A45B 2200/05* (2013.01)

(58) Field of Classification Search
CPC ..... A45B 9/02; A45B 2009/025; A45B 2009/002; F16M 13/08
See application file for complete search history.

(56) References Cited

U.S. PATENT DOCUMENTS 3,810,647 A * 5/1974 Martchenke ..... F16M 13/00 396/420
4,593,933 A * 6/1986 Nunno ..... A63C 11/2224 280/820
4,742,837 A * 5/1988 Rise ..... F16M 13/08 135/66
6,085,766 A * 7/2000 Geary ..... A63C 11/221 135/71
6,139,060 A * 10/2000 Lenhart ..... A45B 9/02 280/821
7,344,320 B2 * 3/2008 Barker ..... F16M 11/14 396/419
7,905,667 B2 * 3/2011 Barker ..... F16M 11/16 396/419

FOREIGN PATENT DOCUMENTS

GB 2589319 A * 6/2021 ..... A45B 3/00

* cited by examiner

*Primary Examiner* — Noah Chandler Hawk
(74) *Attorney, Agent, or Firm* — Bruce Stone LLP; Joseph A. Bruce

(57) ABSTRACT

A walking stick grip is defined with track slots for receiving a connecting buckle of a photographic device and with a convex portion engageable in a sliding groove of the connecting buckle and hence connectable to the photographic device. After taking pictures with the photographic device connected to the walking stick grip, the photographic device can be detached, and a cover body can be mounted on the grip, with the convex portion received in a sliding groove of the cover body, and convex sections of the cover body respectively pressed against blocking portions of the grip so that the portion of the grip that is mounted with the cover body can be gripped. The walking stick grip, therefore, facilitates picture taking as well as hiking.

8 Claims, 7 Drawing Sheets

WALKING STICK GRIP

BACKGROUND OF THE INVENTION

1. Technical Field

The present invention relates to a walking stick and more particularly to the grip structure of a walking stick.

2. Description of Related Art

Walking sticks for use in hiking, also known as trekking poles, have become essential equipment in hiking activities because they can help a user exert a pushing force when the user is going uphill and help support the user when the user is going downhill, thereby allowing the user to make good use of their limbs and reducing the load on the user's knees. If, however, a hiker walking with the assistance of the trekking pole in each hand wishes to take a selfie when in sight of a beautiful mountain, the trekking poles must be put down before the hiker can take a selfie stick from inside their backpack or from a side pocket of the backpack, mount a camera on the selfie stick, and take the selfie. Moreover, once the selfie is taken, the hiker may not know where to put the selfie stick to facilitate later use and therefore inserts the selfie stick into a loop formed by a fixing strap attached to the user's waist, in anticipation of the next beautiful scene. When so placed, however, the selfie stick is very likely to fall off or collide with other objects during hiking and thus cause damage to the camera mounted on the selfie stick, which if happening will be a loss outweighing the convenience of carrying the selfie stick on or near the user's waist.

In addition, inserting the selfie stick in the loop formed by the fixing strap on the user's waist may cause discomfort to the user. It is therefore highly desirable to develop a walking stick, or a grip structure thereof, that makes it easier for its user to take pictures while hiking.

BRIEF SUMMARY OF THE INVENTION

The present invention provides a walking stick grip, the primary objective being to make it easier for a hiker to hike and take pictures as well.

To achieve the foregoing objective, the walking stick grip of the present invention includes a grip and a cover body.

The grip is configured to be connected to one end of a trekking pole and has a connecting end face. The connecting end face has two lateral sides each provided with a blocking portion. Each blocking portion has a track slot. A convex portion is provided between the two blocking portions. The track slots are configured to receive a connecting buckle of a photographic device. The convex portion is configured to be engaged in a sliding groove of the connecting buckle.

The cover body has a fastener and a grip cover. The fastener has two opposite sides respectively defined as a first side and a second side. The first side faces the connecting end face. The grip cover is located on the second side of the fastener. The fastener further has two pressing portions and a track slot portion. The track slot portion is located between the two pressing portions. Each of the two pressing portions has a convex section and a concave section. The track slot portion has a sliding groove for receiving the convex portion. Each convex section is pressed against the corresponding blocking portion, and each concave section is located in the corresponding track slot.

It can be known from the above that the track slots in the present invention can be used to receive the connecting buckle of the photographic device, with the convex portion engaged in the sliding groove of the connecting buckle and thus connected to the photographic device. When no longer needed for picture taking, the photographic device can be detached, allowing the fastener of the cover body to be mounted on the grip, with the convex portion received in the sliding groove of the fastener, and the convex sections respectively pressed against the blocking portions so that the portion of the grip that is mounted with the cover body can be gripped by the user. Thus, the walking stick grip facilitates both hiking and picture taking.

DETAILED DESCRIPTION OF THE INVENTION

Figure 1:
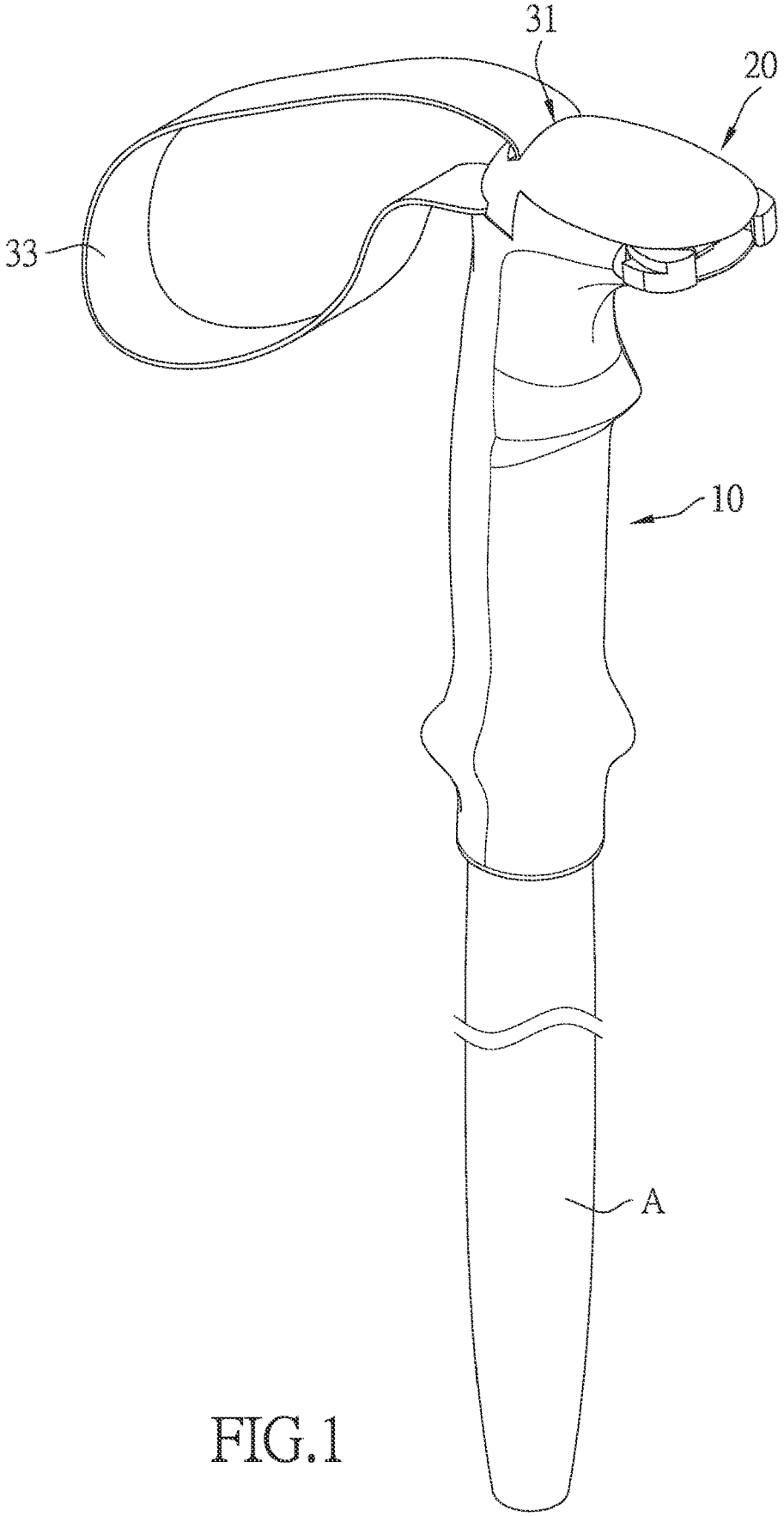
FIG. 1 is a perspective view of the walking stick grip according to the first embodiment of the present invention.

Referring to FIG. 1 to FIG. 7, the walking stick grip of the present invention includes a grip 10 and a cover body 20.

The grip 10 is configured to be connected to one end of a trekking pole A. The grip 10 has a connecting end face 11. The connecting end face 11 has two lateral sides each provided with a blocking portion 111. Each blocking portion 111 has a sidewall 1111 and a top wall 1112. Each sidewall 1111 has one end connected to the connecting end face 11 and the opposite end connected to the corresponding top wall 1112. Each sidewall 1111 and the corresponding top wall 1112 form an included angle therebetween. Each sidewall 1111 and the corresponding top wall 1112 also form a track slot 1113 therebetween. The two blocking portions 111 are respectively defined as a first blocking portion 111A and a second blocking portion 111B. A convex portion 112 is provided between the first blocking portion 111A and the second blocking portion 111B. The convex portion 112 extends along a longitudinal direction X.

The track slots 1113 are configured to receive a connecting buckle Z1 of a photographic device Z, and the convex portion 112 is configured to be engaged in a sliding groove Z11 of the connecting buckle Z1.

The cover body 20 has a fastener 21 and a grip cover 22. The fastener 21 has two opposite sides respectively defined as a first side 21A and a second side 21B. The first side 21A faces the connecting end face 11. The grip cover 22 is located on the second side 21B of the fastener 21. The fastener 21 further has two pressing portions 211 and a track slot portion 212. The track slot portion 212 is located between the two pressing portions 211. Each of the two pressing portions 211 has a convex section 211A and a concave section 211B. The track slot portion 212 has a sliding groove 212A, and the sliding groove 212A extends along the longitudinal direction X. The sliding groove 212A is configured to receive the convex portion 112. Each convex section 211A is pressed against the corresponding blocking portion 111, and each concave section 211B is located in the corresponding track slot 1113, such that the cover body 20 is connected to the grip 10.

The grip cover 22 and the fastener 21 may be integrally formed as a single unit or be two separate components.

Figure 2:
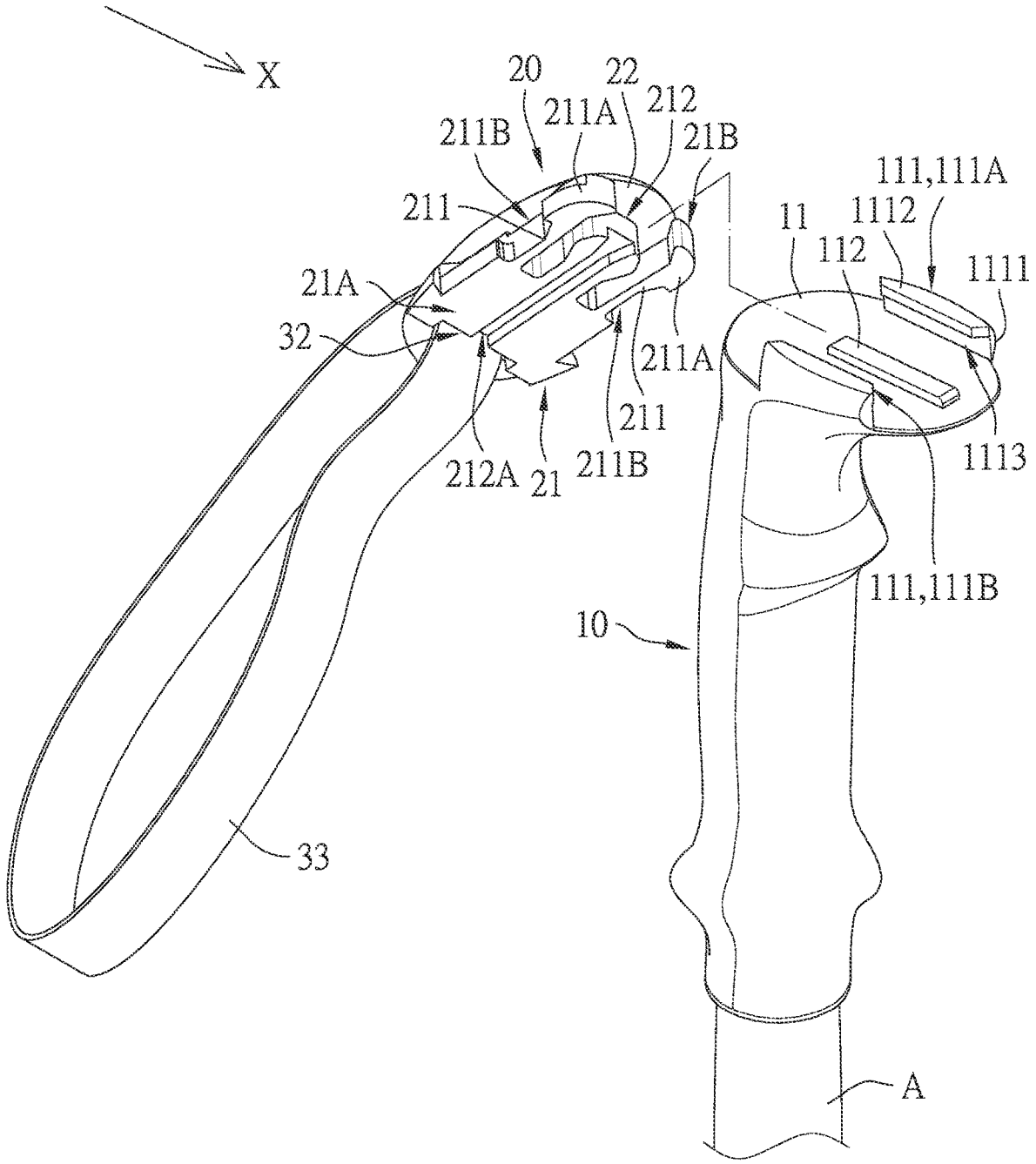
FIG. 2 is an exploded view of the walking stick grip according to the first embodiment of the invention.

According to the first embodiment of the present invention, referring to FIG. 1 and FIG. 2, the grip cover 22 has a first insertion hole 31, and the fastener 21 has a second insertion hole 32. There is also a first grip strap 33, and the first grip strap 33 is inserted through the first insertion hole 31 and the second insertion hole 32. The first grip strap 33 is in the shape of a loop and is configured to be held by the user.

Figure 3:
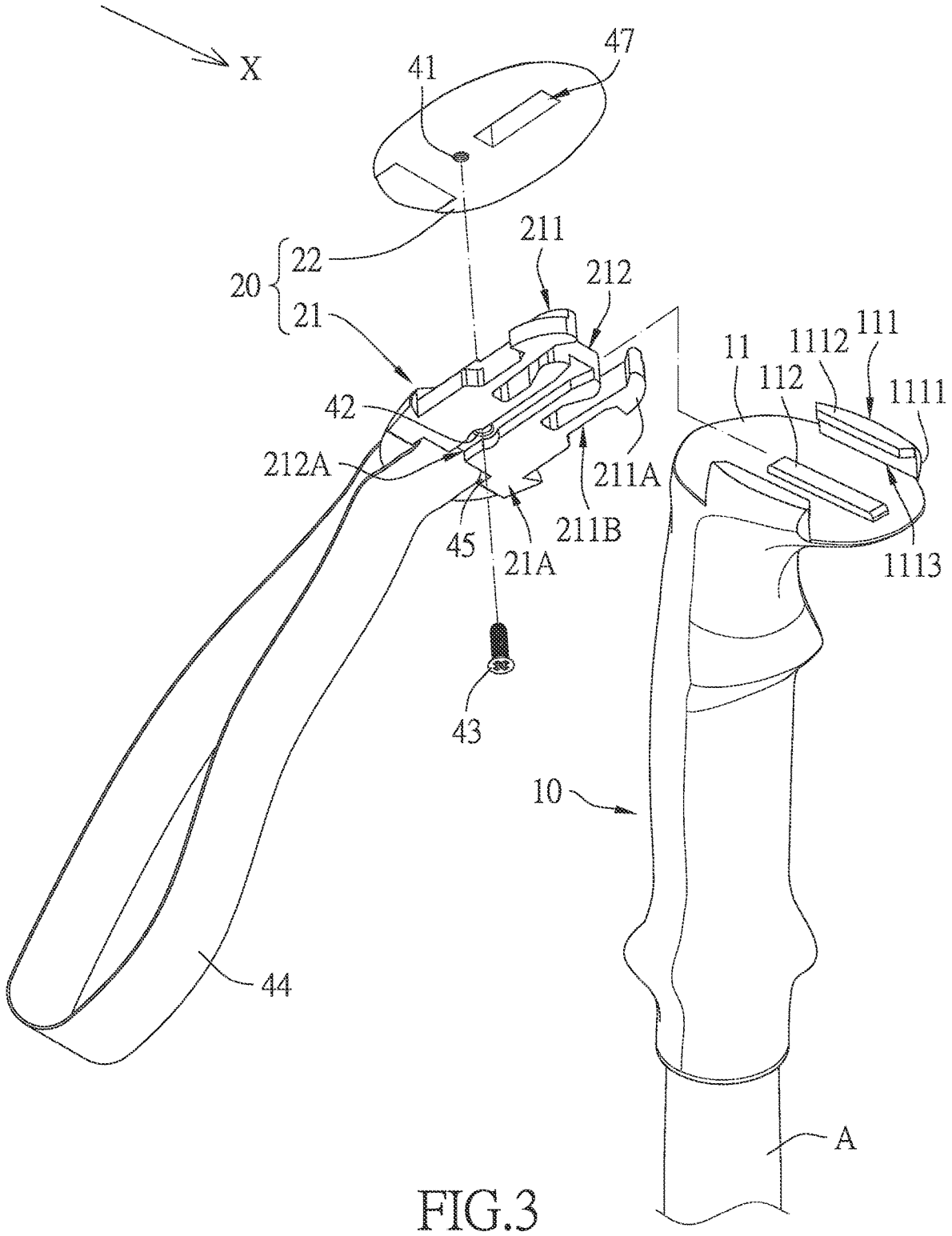
FIG. 3 is an exploded view of the walking stick grip according to the second embodiment of the invention.
Figure 4:
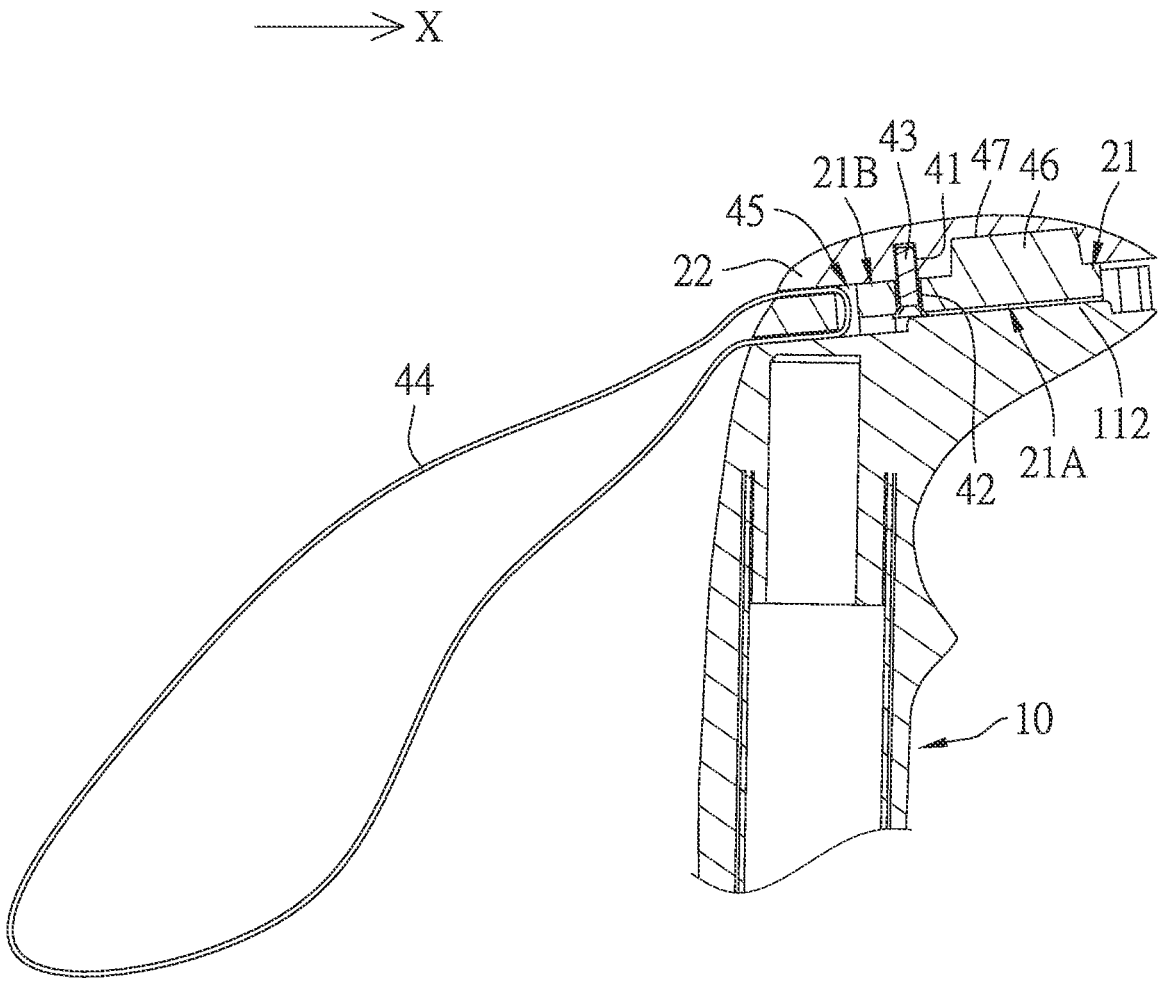
FIG. 4 is a sectional view of the walking stick grip according to the second embodiment of the invention.

According to the second embodiment of the present invention, referring to FIG. 3 and FIG. 4, the grip cover 22 has a first locking hole 41, and the fastener 21 has a second locking hole 42. There is also a threaded locking member 43, and the threaded locking member 43 is passed through the second locking hole 42 and locked in the first locking hole 41 such that the grip cover 22 and the fastener 21 are connected together.

In the second embodiment, there is also a second grip strap 44, and the fastener 21 further has a third insertion hole 45. The second grip strap 44 is inserted through the third insertion hole 45, is in the shape of a loop, and is configured to be held by the user.

In the second embodiment, the side of the fastener 21 that faces the grip cover 22, i.e., the second side 21B, has a first engaging block 46, and the side of the grip cover 22 that faces the fastener 21 has a first engaging recess 47. The first engaging block 46 is fixedly engaged in the first engaging recess 47. Preferably, the first engaging block 46 is located at the track slot portion 212.

Figure 5:
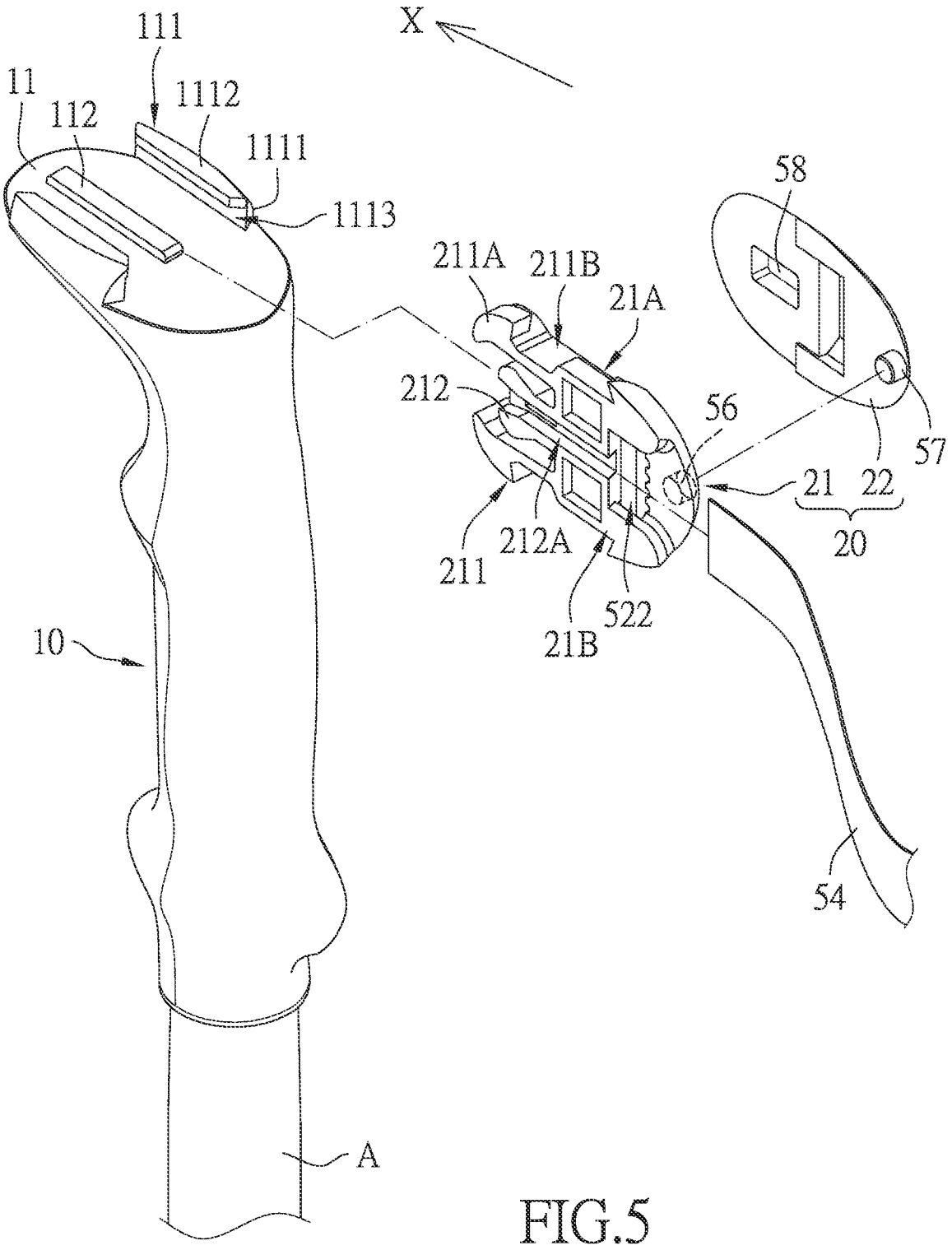
FIG. 5 is an exploded view of the walking stick grip according to the third embodiment of the invention.
Figure 6:
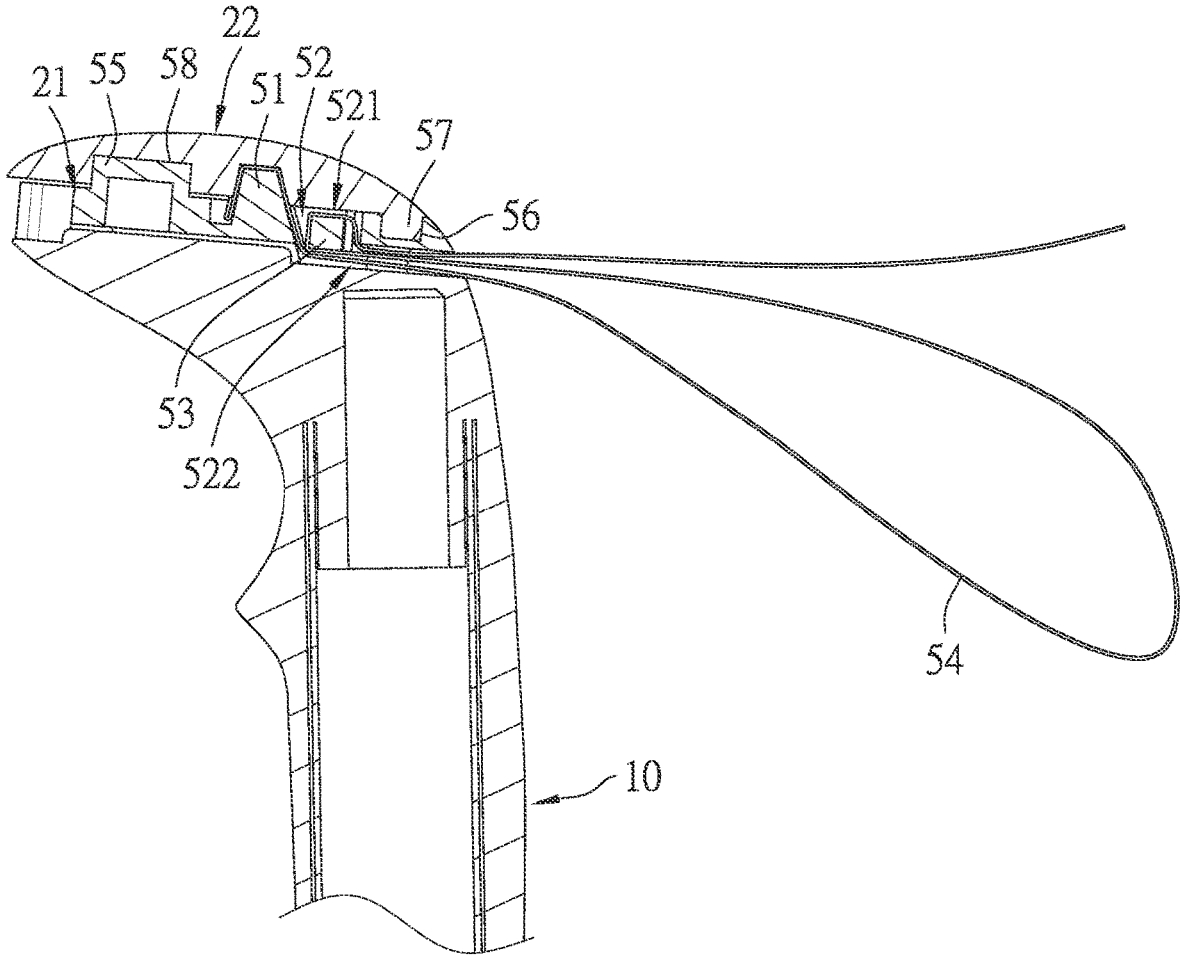
FIG. 6 is a sectional view of the walking stick grip according to the third embodiment of the invention.
Figure 7:
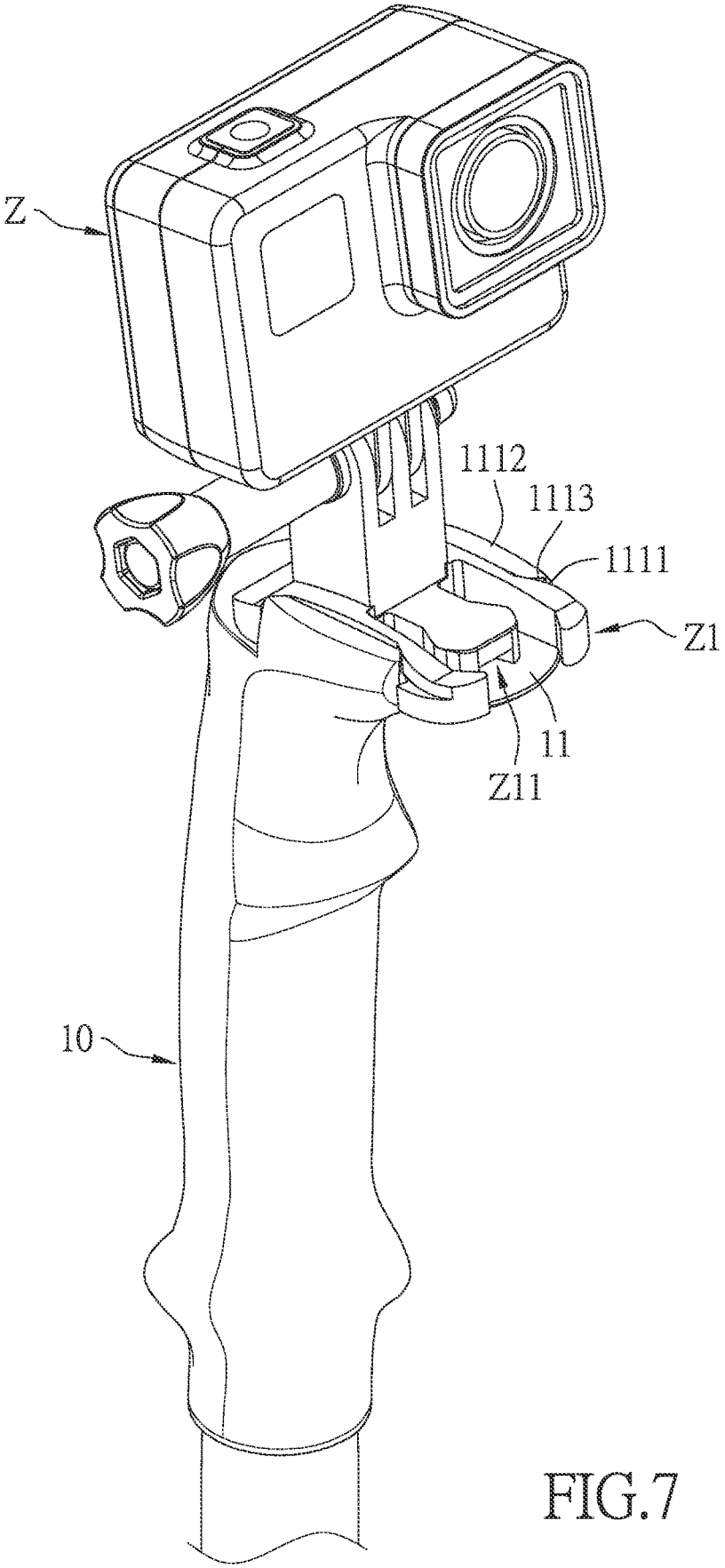
FIG. 7 shows a state of use of the walking stick grip according to any of the disclosed embodiments of the invention.

According to the third embodiment of the present invention, referring to FIG. 5 and FIG. 6, the fastener 21 has a first fitting block 51 and a through groove 52. The through groove 52 extends through the fastener 21. The through groove 52 has two opposite groove openings respectively defined as a first groove opening 521 and a second groove opening 522. The first groove opening 521 faces the grip cover 22. The second groove opening 522 faces the connecting end face 11. The through groove 52 is adjacent to the first fitting block 51. The through groove 52 is provided therein with a fixing block 53. The fixing block 53 is a generally rectangular block. There is also a third grip strap 54, and the third grip strap 54 has one end fixed to the first fitting block 51, extends out of the through groove 52 through the second groove opening 522, reenters the through groove 52 through the second groove opening 522 while surrounding the fixing block 53, and then extends out of the second groove opening 522 again in order for the end of the third grip strap 54 that is not fixed to the first fitting block 51 to extend out of the cover body 20. Thus, by pulling the third grip strap 54, the user can adjust the length of the loop formed by the third grip strap 54.

In the third embodiment, the side of the fastener 21 that faces the grip cover 22, i.e., the second side 21B, has a second engaging block 55 and a second engaging recess 56, and the side of the grip cover 22 that faces the fastener 21 has a third engaging block 57 and a third engaging recess 58. The second engaging block 55 is engaged in the third engaging recess 58, and the third engaging block 57 is engaged in the second engaging recess 56, such that the fastener 21 and the grip cover 22 are connected together.

Preferably, the second engaging block 55 is located at the track slot portion 212.

What is claimed is:

1. A walking stick grip, comprising:

a grip configured to be connected to an end of a trekking pole, wherein the grip has a connecting end face, the connecting end face has two lateral sides each provided with a blocking portion, each said blocking portion has a track slot, there is a convex portion between the two blocking portions, the track slots are configured to receive a connecting buckle of a photographic device, and the convex portion is configured to be engaged in a sliding groove of the connecting buckle; and a cover body having a fastener and a grip cover, wherein the fastener has two opposite sides respectively defined as a first side and a second side, the first side faces the connecting end face, the grip cover is located on the second side of the fastener, the fastener further has two pressing portions and a track slot portion, the track slot portion is located between the two pressing portions, each of the two pressing portions has a convex section and a concave section, the track slot portion has a sliding groove for receiving the convex portion, each said convex section is pressed against a corresponding one of the blocking portions, and each said concave section is located in a corresponding one of the track slots.

2. The walking stick grip of claim 1, wherein each said blocking portion has a sidewall and a top wall, each said sidewall has an end connected to the connecting end face and another end connected to a corresponding one of the top walls, each said sidewall and the corresponding top wall form an included angle therebetween, and each said sidewall and the corresponding top wall also form a corresponding said track slot therebetween.

3. The walking stick grip of claim 1, wherein the grip cover has a first insertion hole, the fastener has a second insertion hole, there is also a first grip strap, the first grip strap is inserted through the first insertion hole and the second insertion hole, and the first grip strap is shaped as a loop.

4. The walking stick grip of claim 1, wherein the grip cover has a first locking hole, the fastener has a second locking hole, there is also a threaded locking member, and the threaded locking member is passed through the second locking hole and locked in the first locking hole.

5. The walking stick grip of claim 4, wherein there is also a second grip strap, the fastener has a third insertion hole, the second grip strap is inserted through the third insertion hole, and the second grip strap is shaped as a loop.

6. The walking stick grip of claim 4, wherein the second side of the fastener has a first engaging block, the grip cover has a side facing the fastener and provided with a first engaging recess, and the first engaging block is fixedly engaged in the first engaging recess.

7. The walking stick grip of claim 1, wherein the fastener has a first fitting block and a through groove, the through groove extends through the fastener, the through groove has two opposite groove openings respectively defined as a first groove opening and a second groove opening, the first groove opening faces the grip cover, the second groove opening faces the connecting end face, the through groove is adjacent to the first fitting block, the through groove is provided therein with a fixing block, there is also a third grip strap, and the third grip strap has an end fixed to the first fitting block, extends out of the through groove through the second groove opening, reenters the through groove through the second groove opening while surrounding the fixing block, and then extends out of the second groove opening again in order for an end of the third grip strap that is not fixed to the first fitting block to extend out of the cover body.

8. The walking stick grip of claim 7, wherein the second side of the fastener has a second engaging block and a second engaging recess, the grip cover has a side facing the fastener and provided with a third engaging block and a third engaging recess, the second engaging block is engaged in the third engaging recess, and the third engaging block is engaged in the second engaging recess, such that the fastener and the grip cover are connected together.

* * * * *